US005601133A

United States Patent [19]

Krupke et al.

[11] Patent Number: 5,601,133

[45] Date of Patent: Feb. 11, 1997

[54] ROLL-UP DOOR

[75] Inventors: LeRoy G. Krupke, Carrollton; Douglas R. Fuller, Garland; Dennis A. Kalgren, Richardson; Anthony J. Shelton, Garland, all of Tex.

[73] Assignee: Overhead Door Corporation, Dallas, Tex.

[21] Appl. No.: 441,816

[22] Filed: May 16, 1995

Related U.S. Application Data

[63] Continuation-in-part of Ser. No. 414,580, Mar. 31, 1995.

[51] Int. Cl.[6] ..... A47G 5/02

[52] U.S. Cl. ..... 160/265; 160/271

[58] Field of Search ..... 160/265, 271, 160/274, 310, 267.1, 268.1, 291, 133, 23.1

[56] References Cited

U.S. PATENT DOCUMENTS

| | | | |
|---|---|---|---|
| 755,675 | 3/1904 | Kirby, Jr. . | |
| 1,083,096 | 12/1913 | Hobling . | |
| 1,764,880 | 6/1930 | Nelson . | |
| 1,766,730 | 6/1930 | Traut . | |
| 1,783,152 | 11/1930 | Oldham . | |
| 2,839,135 | 6/1958 | Anderson | 160/133 |
| 3,180,401 | 3/1962 | Shade | 160/265 |
| 3,460,602 | 8/1969 | Hugus | 160/265 |
| 3,848,653 | 11/1974 | Youngs | 160/120 |
| 3,878,879 | 4/1975 | Manns | 160/273 |
| 4,690,194 | 9/1987 | Seuster | 160/265 |
| 4,690,195 | 9/1987 | Taylor | 160/310 |
| 4,887,660 | 12/1989 | Kraus | 160/265 |
| 4,889,176 | 12/1989 | Nilsson | 160/264 |
| 4,976,302 | 12/1990 | Taylor | 160/310 |
| 5,025,847 | 6/1991 | Mueller | 160/270 |
| 5,048,588 | 9/1991 | Weishar et al. | 160/265 |
| 5,056,579 | 10/1991 | Krafutler | 160/271 |
| 5,070,925 | 12/1991 | Paule | 160/133 |
| 5,129,442 | 7/1992 | Warner | 160/264 |
| 5,139,074 | 8/1992 | Warner | 160/271 |
| 5,141,043 | 8/1992 | Kraeutler | 160/264 |
| 5,141,044 | 8/1992 | Hying et al. | 160/271 |
| 5,271,448 | 12/1993 | Delgado | 160/265 |
| 5,353,859 | 10/1994 | Oltahfer et al. | 160/310 |
| 5,368,084 | 11/1994 | Hying et al. | 160/265 |
| 5,392,836 | 2/1995 | West et al. | 160/273.1 |
| B1 4,478,268 | 4/1991 | Palmer | 160/310 |

*Primary Examiner*—David M. Purol

*Attorney, Agent, or Firm*—Akin, Gump, Strauss, Hauer & Feld, L.L.P.

[57] ABSTRACT

A flexible roll-up door assembly includes opposed, elongated frame members supporting guides for longitudinal side edges of the door and for slide members connectable to a bottom beam of the door closure member by a latch mechanism which includes opposed latch members which engage the slide members, respectively. The slide members rotate to permit the latch members to separate in response to a predetermined force acting on the door closure or the bottom beam. The latch members are spring biased to retract out of or extend into cooperating slots in the slide members and may be reinserted in the slide members to reconnect the door to the guides. The latch members may include retaining projections cooperable with reentrant edges or other surfaces in the slots to retain the latch members engaged with the slide members. Alternate embodiments include latch members formed on the slide members and engaged in slots formed in a transverse bottom beam for the door closure member. Spaced apart tensioning reels are mounted on the door closure shaft and support cables which are trained through the guides and are connected to the slide members to apply a pulldown tensioning force on the door closure member. Pivotable brake arms, disposed adjacent the tensioning reels, have the tensioning cables trained thereover and are responsive to disconnection of the door bottom beam from the slide members to engage the tensioning reels to reduce the speed of cable windup.

6 Claims, 12 Drawing Sheets

ROLL-UP DOOR

CROSS-REFERENCE TO RELATED APPLICATION

This application is a continuation-in-part of U.S. patent application Ser. No. 08/414,580, filed Mar. 31, 1995.

FIELD OF THE INVENTION

The present invention pertains to a flexible, fabric type roll-up door assembly including a unique bottom bar breakaway connection, tensioning and counterbalance spring arrangement and door edge guide configuration.

BACKGROUND

So-called roll or roll-up type doors are widely used in industrial applications to close off sections of industrial buildings or to seal a doorway which opens to the exterior of the building. Such doors are typically characterized by a flexible, fabric curtain type closure member supported on a rotatable shaft wherein the side edges of the closure member are disposed in opposed guideways on opposite sides of the doorway and the door is controlled for rapid opening and closing action. Since such doors are often used in facilities wherein there is a substantial amount of traffic through the doorway, releasable or so-called breakaway connections have been developed to permit the door closure member to be released from the guideways if struck by a vehicle traversing the doorway to prevent or reduce damage to the door, the vehicle or injury to personnel exposed to such incidents. Other features which have been considered desirable for roll-up doors include a support frame which reduces the space occupied along each side of the doorway, ease of erection and assembly of the door at the site and a door actuating mechanism which does not exert the full force or torque of the drive motor on the door bottom edge, in the event that an object is in the doorway when the door moves to a closed position.

There have been several developments in breakaway connection devices between opposed sides of a roll-up door at the bottom edge and the door guideways. Many of these connection devices are relatively complex and require a substantial amount of time to reconnect the door to the guideways and the door actuating mechanism if the breakaway connection is released. Prior art door breakaway connections include types wherein a pivoting latch member is held in position by a detent member and pivots or releases from the detent to permit operation of the breakaway connection. Other types of breakaway connections include frangible pin type connections which must be replaced once the breakaway connection has actuated.

Roll-up type doors are also typically adapted to be actuated in such a way that the door closure member is always under tension in order to keep the flexible fabric in a relatively stiff operating condition to provide proper functioning of the door. Relatively complex cable and travelling weight mechanisms have been developed for tensioning the door and counterbalancing the weight of the door. Somewhat complicated counterbalance spring arrangements have been developed which are disposed within the door roll support shaft or drum.

Accordingly, there has been a need to develop a breakaway connection which is mechanically uncomplicated, reliable in operation and provides for relatively easy reconnection of the door bottom bar or bottom edge to the door traversing mechanism and guideway. There has also been a need to improve the door side edge seals to provide for a substantially weather-tight seal at the doorway. Still further, a need has existed for improvements in the mechanism which provides for tensioning the door bottom edge under all operating conditions. The present invention provides solutions to the above-mentioned problems associated with roll-up doors as well as providing other advances in the art of such doors.

SUMMARY OF THE INVENTION

The present invention provides a roll-up type door or barrier including a unique releasable connection between the door bottom edge and opposed door guideways, an improved door tensioning mechanism, unique door side edge guideways, improved wind bar deployment mechanism and a unique counterbalance mechanism.

In accordance with one important aspect of the invention, a releasable, "breakaway" type connection is provided between a transverse door bottom beam or bar and opposed guideways for the door side edges wherein opposed, movable latch members are releasably engageable with opposed slide members disposed in the guideways and normally attached to the door through the bottom bar and latch members for tensioning the door closure member.

In one preferred embodiment of the breakaway connection, the latch members comprise movable bar or fin type members which are disposed in cooperating slots formed in the slide members. The latch members include projections which may be engaged with reentrant edges formed in the slots to hold the latch members in engagement with the slide members. The latch members are spring biased to tend to move out of the slots to retract in response to a force exerted on the latch members which tends to rotate the slide members in the guideways.

In another embodiment of the breakaway connection, the latch members are biased into the slots in the slide members and the slide members are provided with projections which cooperate with elongated keyways in guide members forming the guideways. In response to a force tending to separate the latch members from the slide members, the slide members undergo limited rotation to allow the latch members to exit the slots.

In accordance with yet another embodiment of the breakaway connection, the latch members are formed as projecting portions on the slide members which are disposed in cooperating slots formed in a transverse bottom beam connected to the door closure member. In response to a force acting on the door, the latch members and slide members rotate in the guideways to disengage from the bottom beam.

The present invention also provides preferred embodiments of a breakaway connection between the door bottom bar and the opposed guideways wherein the latch members and the slide members have cooperating hook surfaces and retaining pins, respectively, which maintain the latch members connected to the slide members and the latch members and slide members have cooperating cam surfaces which, in response to a breakaway force exerted on the door, effect limited relative movement between the latch members and the slide members to disengage the latch members from the slide members and to bias the latch members into their retracted positions completely disengaged from the slide members.

In accordance with another important aspect of the invention, a roll-up type door is provided with an improved tensioning mechanism including opposed cable reels disposed on the door support shaft and outboard of the opposite side edges of the door closure member. The reels are each connected to a tensioning cable and slider assembly disposed in opposed guideways and the reels include spiral power tensioning springs disposed therein for applying a predetermined tension to the door closure member via the cable and slide assemblies and for acting as counterbalance springs during unrolling of the door. The unique reel construction may be modified to form a secondary counterbalance mechanism which may be operably connected to the door closure member through a chain and sprocket drive and wherein the sprockets may be interchanged to vary the counterbalance effect.

Moreover, the tensioning reel and cable arrangement, together with the connection between the door and the slide members connected to the tensioning cables, provides a pulldown force on the door which is determined by the spring bias on the reels and is not the result of the maximum door drive motor effort. In this way, if an obstruction is struck by the door during closing thereof, and obstruction sensing devices are not activated, a reduced force is exerted on the obstruction to minimize damage thereto or to the door itself.

In accordance with another important aspect of the invention, a roll-up type door is provided with a movable barrier bar to minimize deflection of the door closure member or "curtain" due to wind and other pressure generating forces acting thereon which bar is moveable to selected working positions by a unique cable and takeup reel arrangement supported on the door closure member support shaft.

Still further, the present invention provides unique side edge guide members for a roll-up type door which include side edge seal means for providing a substantially weather-tight seal along the side edges of the door closure member and for supporting a door tensioning slide member for traversal along the guideways in an improved and unique manner.

The above-mentioned guide members and support frames minimize the space occupied by the door adjacent a doorway and minimize floor space occupied by the guide structure. Moreover, the opposed guide members, together with an assembly comprising the door drive motor, the closure support shaft, the closure member and the closure member tensioning mechanism may be easily transported and assembled at the site of installation of the door.

The above-mentioned features together with other important aspects of the present invention will be further appreciated by those skilled in the art upon reading the detailed description which follows in conjunction with the drawing.

DESCRIPTION OF THE PREFERRED EMBODIMENTS

Figure 1:
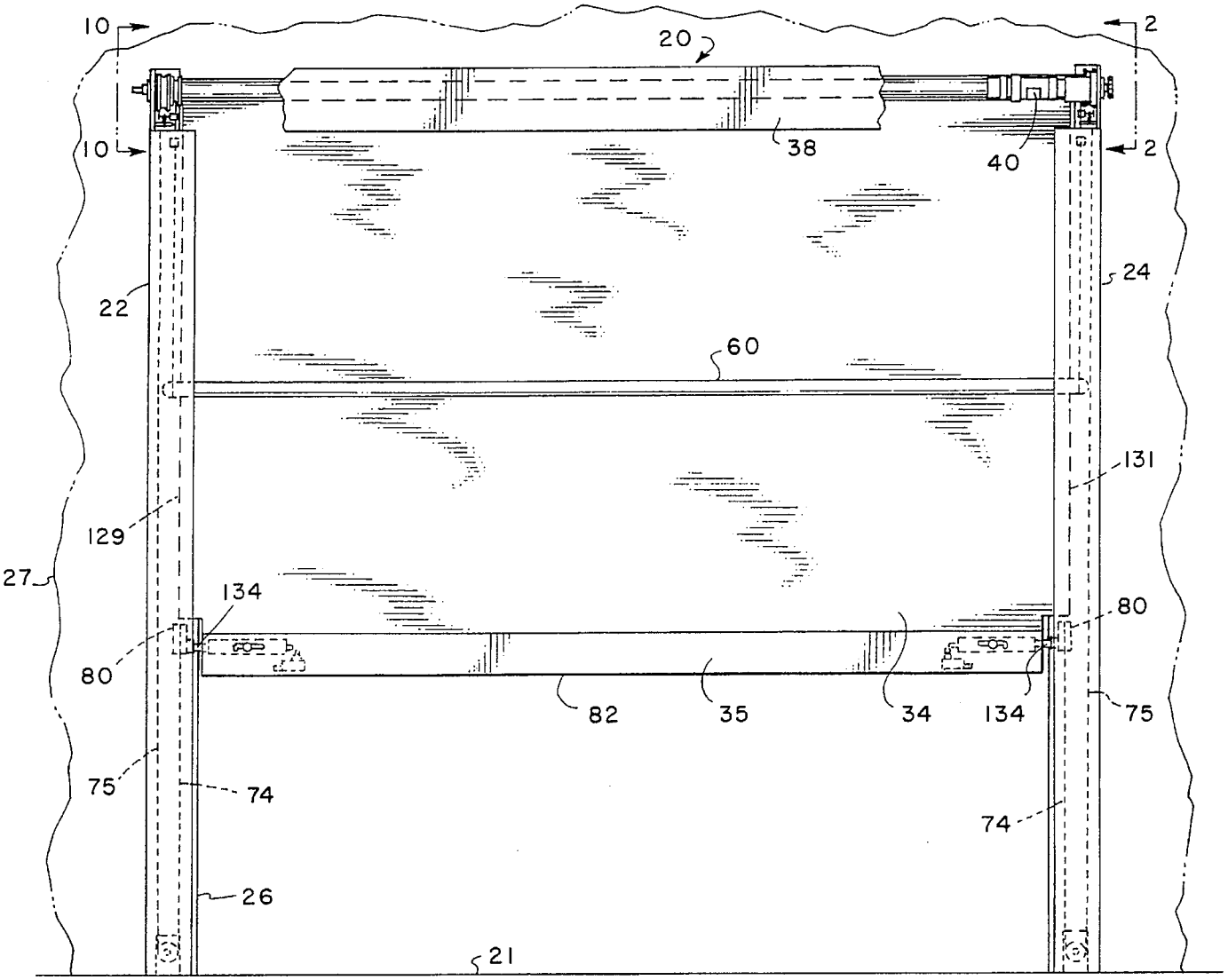
FIG. 1 is a front elevation of a roll-up door in accordance with the present invention.

In the description which follows, like elements are marked throughout the specification and drawing with the same reference numerals, respectively. The drawing figures are not necessarily to scale and certain features may be shown exaggerated in scale or in somewhat schematic form in the interest of clarity and conciseness.

Figure 2:
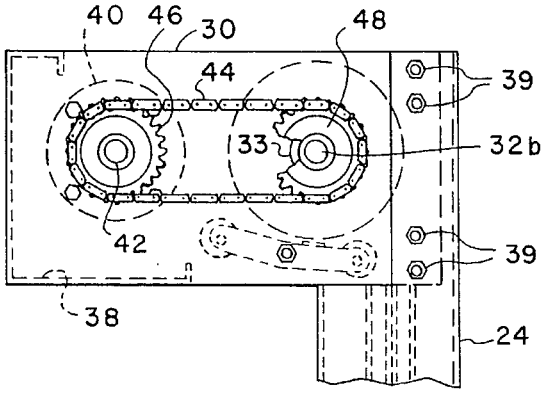
FIG. 2 is a detail view taken generally from the line 2—2 of FIG. 1.
Figure 3:
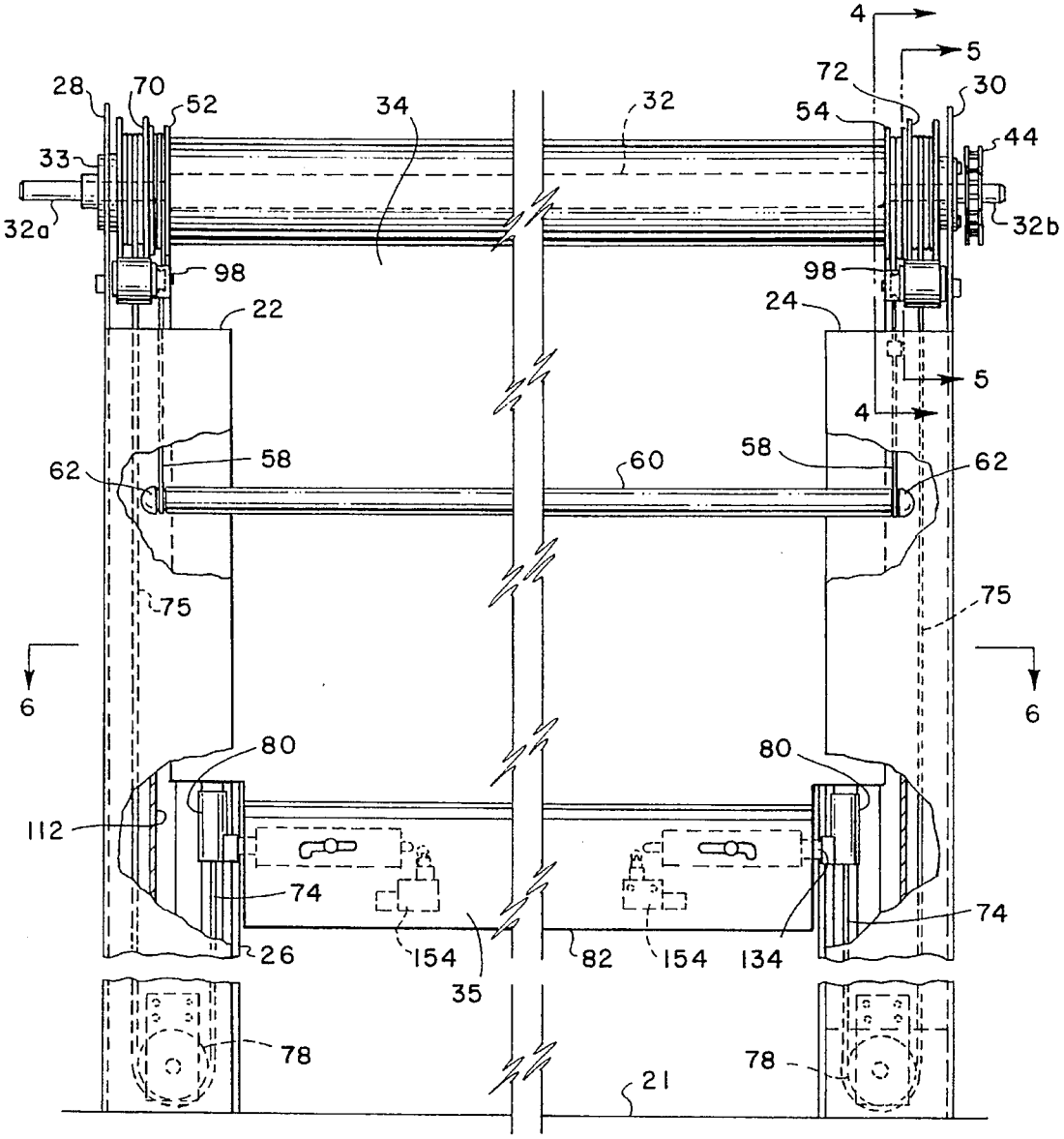
FIG. 3 is a detail front elevation of the upper and lower portions of the door assembly.

Referring primarily to FIGS. 1 and 3, the roll-up door of the present invention is illustrated and generally designated by the numeral 20. The door 20 is characterized by opposed generally vertically extending frame members 22 and 24 which extend along both sides of an opening or doorway 26 formed in a wall 27 for which the door is to form a closure or barrier. Opposed support brackets 28 and 30 are disposed at the top of the frame members 22 and 24 and are adapted to support a rotatable shaft 32, FIG. 3, comprising a spool on which a flexible curtain type door closure member 34 is wound in a conventional manner. The brackets 28 and 30 include suitable bearing means 33, one shown, for supporting opposed reduced diameter shaft portions 32*a* and 32*b* of the shaft 32. The door closure member 34 may comprise a plastic impregnated fabric or the like or a similar flexible structure which is capable of being wound onto and unwound from the shaft or spool 32. A generally channel-shaped headplate or hood 38 extends between and is suitably secured to the support brackets 28 and 30, see FIG. 2, also.

As shown in FIGS. 1 and 2, the shaft 32 is operable to be rotated in opposite directions by a reversible motor and gear reduction unit 40 which is mounted on the support bracket 30 and has a power output shaft 42, FIG. 2, drivingly connected to an endless chain 44 which is trained over sprockets 46 and 48. The sprocket 48 is suitably connected to the shaft end 32*b* for rolling and unrolling the door closure member 34. The motor unit 40 is adapted to be operated at will by suitable operator controls, not shown, and automatically controlled to stop in the event of the door closure member 34 striking an obstruction or the like as will be explained in further detail herein. The motor unit 40 may also incorporate an integral operator controllable brake mechanism, not shown, which is automatically energized to prevent rotation of the motor output shaft 42 when the motor unit is deenergized. The brake mechanism may be manually released, at will. The motor unit 40 may be of a type commercially available such as from U.S. Electrical Motor Div. of Emerson Electric Co., St. Louis, Mo.

Figure 10:
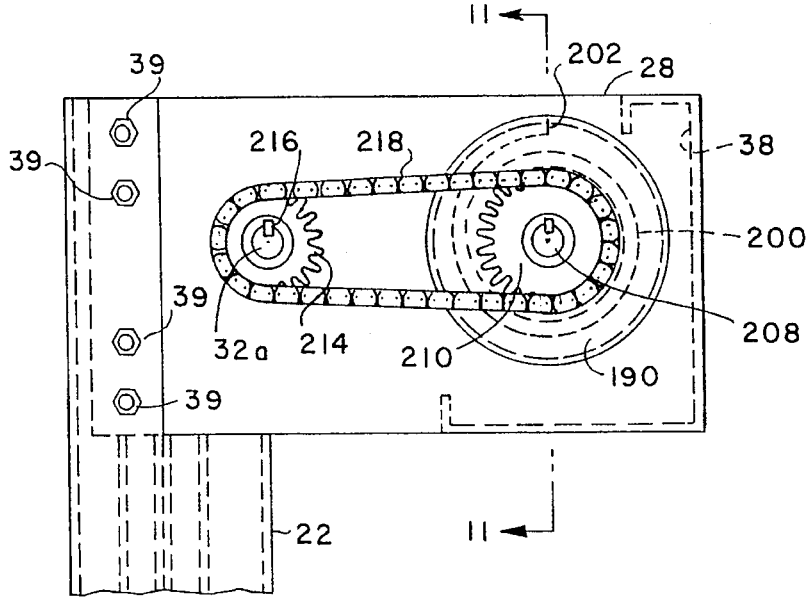
FIG. 10 is a view taken generally from the line 10—10 of FIG. 1 showing a counterbalance device for the door closure member.

The assembly of the headplate or hood 38, together with the opposed support brackets 28 and 30, is adapted to be bolted to the opposed frame members 22 and 24 by suitable fastener means 39, see FIGS. 2 and 10, by way of example. Accordingly, the assembly of the shaft or spool 32 and all of the components supported by the shaft and the brackets 28 and 30 may be separately assembled and connected to the frame members 22 and 24, either before or after these frame members have been erected at the site of installation of the door 20, such as at the doorway 26.

Figure 4:
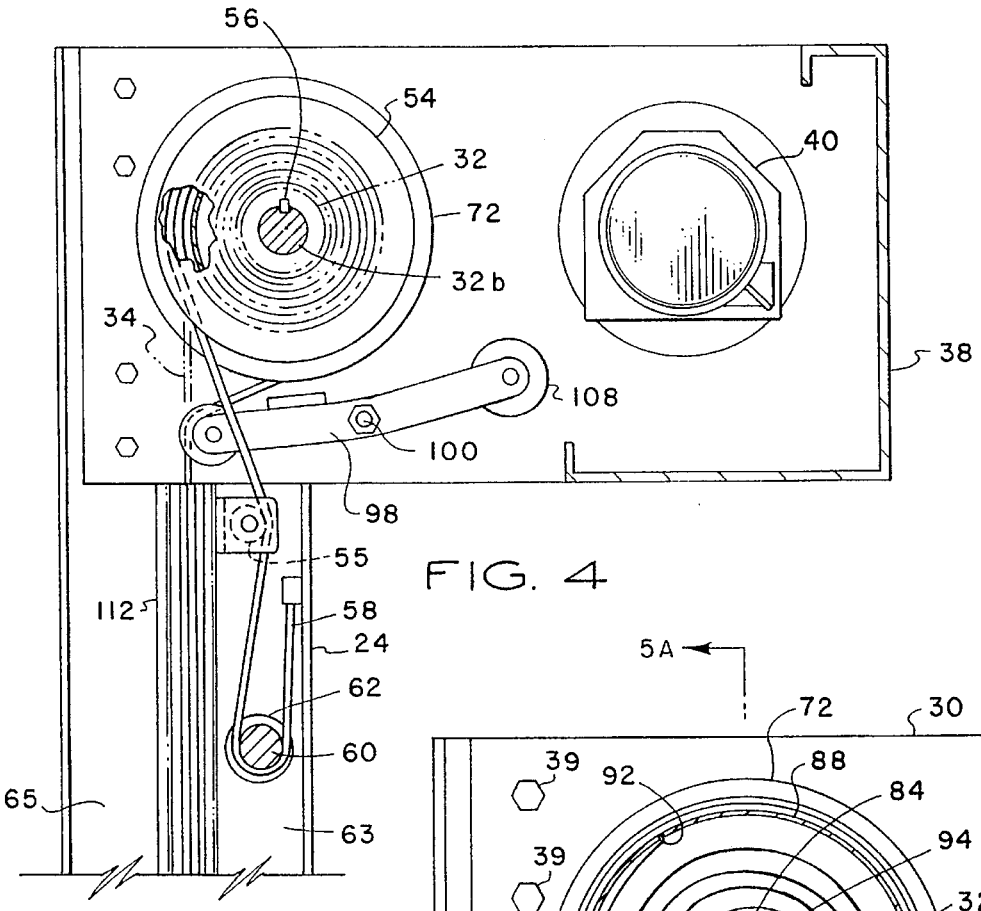
FIG. 4 is a detail view taken generally from the line 4—4 of FIG. 3.

Referring now to FIGS. 3 and 4, the shaft portions 32*a* and 32*b* are adapted to support spaced apart cable reels 52 and 54, which reels are keyed to the respective shaft portions by suitable key means 56, FIG. 4. Each of the reels 52 and 54 has an elongated cable 58 trained thereover and descending through the frame members 22 and 24, respectively, for supporting an elongated transversely extending door support or windbar 60. Opposite ends of the windbar 60, see FIG. 3, have grooved bosses 62 formed thereon and disposed in a guideway 63, see FIG. 4, formed by the opposed frame members 22 and 24. As shown by example in FIG. 4, each of the cables 58 is trained over its respective support reel 52 or 54, over an idler roller 55, around the boss 62 and is secured at its distal end to the upper end of the frame members 22 and 24, respectively. As the door closure member 34 is unwound from the shaft 32 to descend toward the floor 21, FIG. 3, the windbar 60 may descend approximately half the distance from the shaft 32 to the closure member bottom edge, indicated generally at 35, to provide support for the closure member to resist billowing in the event of a substantial pressure differential acting through the opening in a direction toward the side of the opening at which the door 20 is disposed. Alternatively, the windbar 60, the cables 58 and guide pulleys 55 may be disposed in guideways 65, one shown in FIG. 4, formed by the frame members 22 and 24, if the pressure forces act in the opposite direction.

Figure 5A:
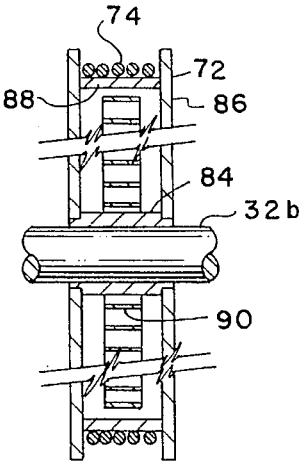
FIG. 5A is a section view taken generally from line 5A—5A of FIG. 5.
Figure 5:
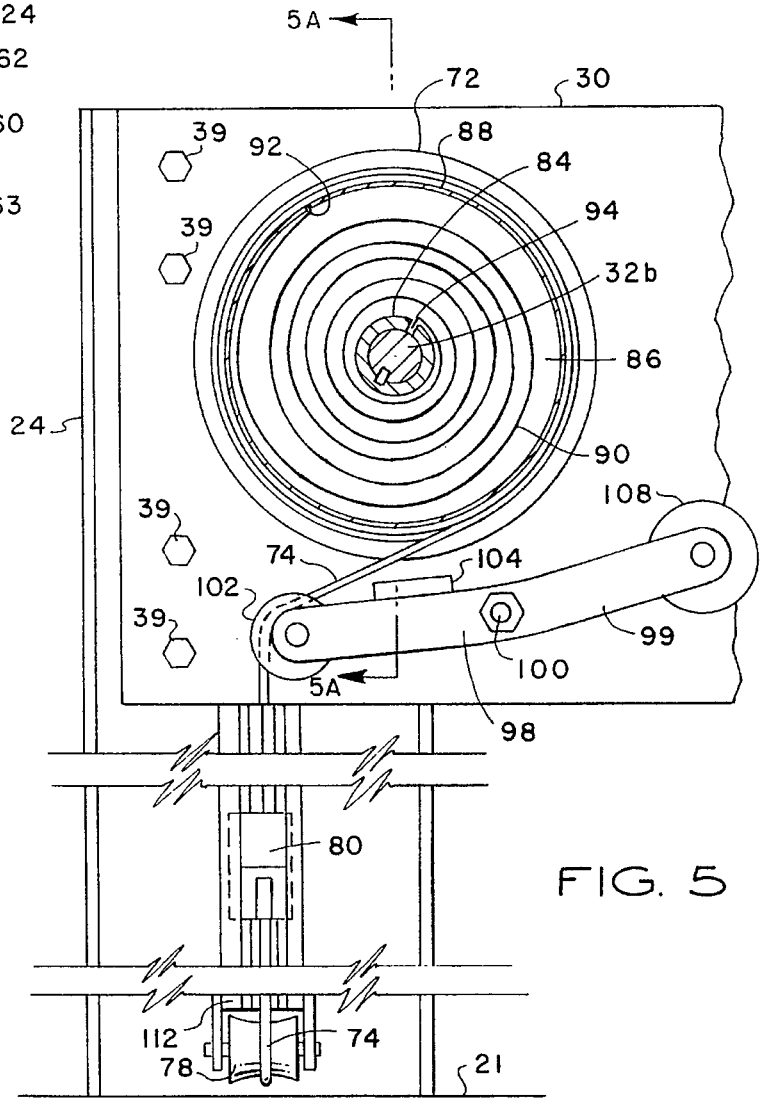
FIG. 5 is a view taken generally from the line 5—5 of FIG. 3.

Referring further to FIG. 3 and also FIG. 5, the door 20 includes a unique tensioning mechanism for maintaining the closure member 34 substantially taut during movement and in a closed as well as rolled up condition, which mechanism is characterized by spaced apart tensioning reels 70 and 72 which are mounted on the shaft portions 32*a* and 32*b* outboard of the windbar cable reels 52 and 54, as shown. Elongated flexible cables 74 are trained around and secured to the reels 70 and 72, respectively, descend along the frame members 22 and 24 and are trained around respective pulleys 78 disposed at the bottom of the frame members 22 and 24, respectively. The distal ends of the cables 74 are connected to generally cylindrical slide members 80 which, in turn, are releasably connected to the door closure member 34, generally at its bottom transverse edge 35 for tensioning the closure member as mentioned previously. The slide members 80 comprise part of a unique latch mechanism to be described below, other parts of which are mounted on a substantially stiff transverse beam 82 extending across and defining the bottom edge 35 of the door and suitably secured to the flexible closure member 34 at 79, see FIG. 7.

Referring now to FIGS. 5 and 5A, certain details of the reel 72 are illustrated. The reel 70 is identical to the reel 72. The reel 72 includes a hub 84 mounted on the shaft portion 32*b* and suitably keyed thereto for rotation with the shaft 32. The hub 84 also supports a generally cylindrical case 86 which is rotatable relative to the hub. The case 86 includes a cable drum 88 on which a cable 74 is secured and adapted to be wound thereon. A generally spiral band type spring 90 is disposed in the case 86 and is secured to the drum 88 at one end 92 and to the hub 84 at an opposite end 94, as illustrated. The spring 90 may be pretensioned so that it has a tendency to wind the cable 74 onto the drum 88 by rotating the case 86 in a counterclockwise direction, viewing FIG. 5. When the door closure member 34 is unwound from the shaft 32 in a counterclockwise direction, viewing FIG. 5, the shaft 32 will tend to turn more revolutions as the closure member is unwound since the diameter of the hub 88 is greater than the maximum diameter of the rolled up closure member 34. In this way, the spring 90 tends to be wound tighter increasing the tension on the cable 74 and closure member 34 and acting to counterbalance the weight of the closure portion of the member 34 which becomes unreeled from the shaft 32.

Referring further to FIG. 5, each of the reels 70 and 72 is provided with a unique braking mechanism to minimize rapid rotation of the case 86 in the event of a disconnection between the slide members 80 and the bottom beam 82. Each brake mechanism comprises an arm 98 pivotally mounted about a pivot pin 100 suitably secured to the support bracket 28 or 30, respectively. A rotatable sheave 102 is supported on one end of the brake arm 98 over which the cable 74 is trained, as illustrated. A brake shoe 104 is mounted on the brake arm 98 between the sheave 102 and the pivot pin 100. The arm 98 includes a distal projecting end portion 99 extending in a direction from the pivot 100 opposite the direction of the sheave 102 and supports a counterweight 108. Tension in the cable 74 maintains the brake arm 98 in a position where the brake shoe 104 is clear of the drum 88. When the door bottom beam 82 becomes disconnected from the slide members 80, the reels 70 and 72 will tend to rotate rapidly, however, relaxation of the cables 74 will allow the brake arms 98 to pivot about their pivot pins 100 to engage the brake shoes 104 with the respective reels to at least reduce the speed of rotation so that the slide members 80 move down to the bottom of the frame members 22 and 24 at substantially reduced speed.

Figure 6:
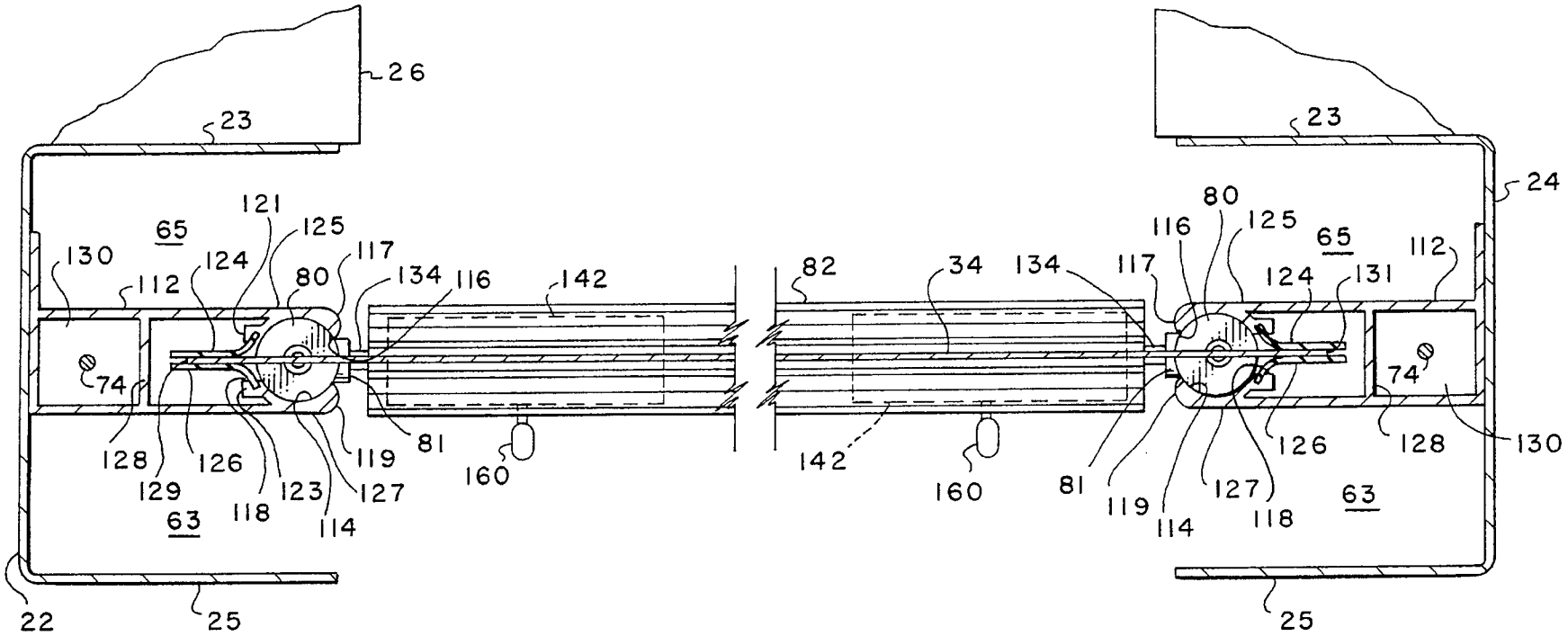
FIG. 6 is a section view taken generally from the line 6—6 of FIG. 3.
Figure 7:
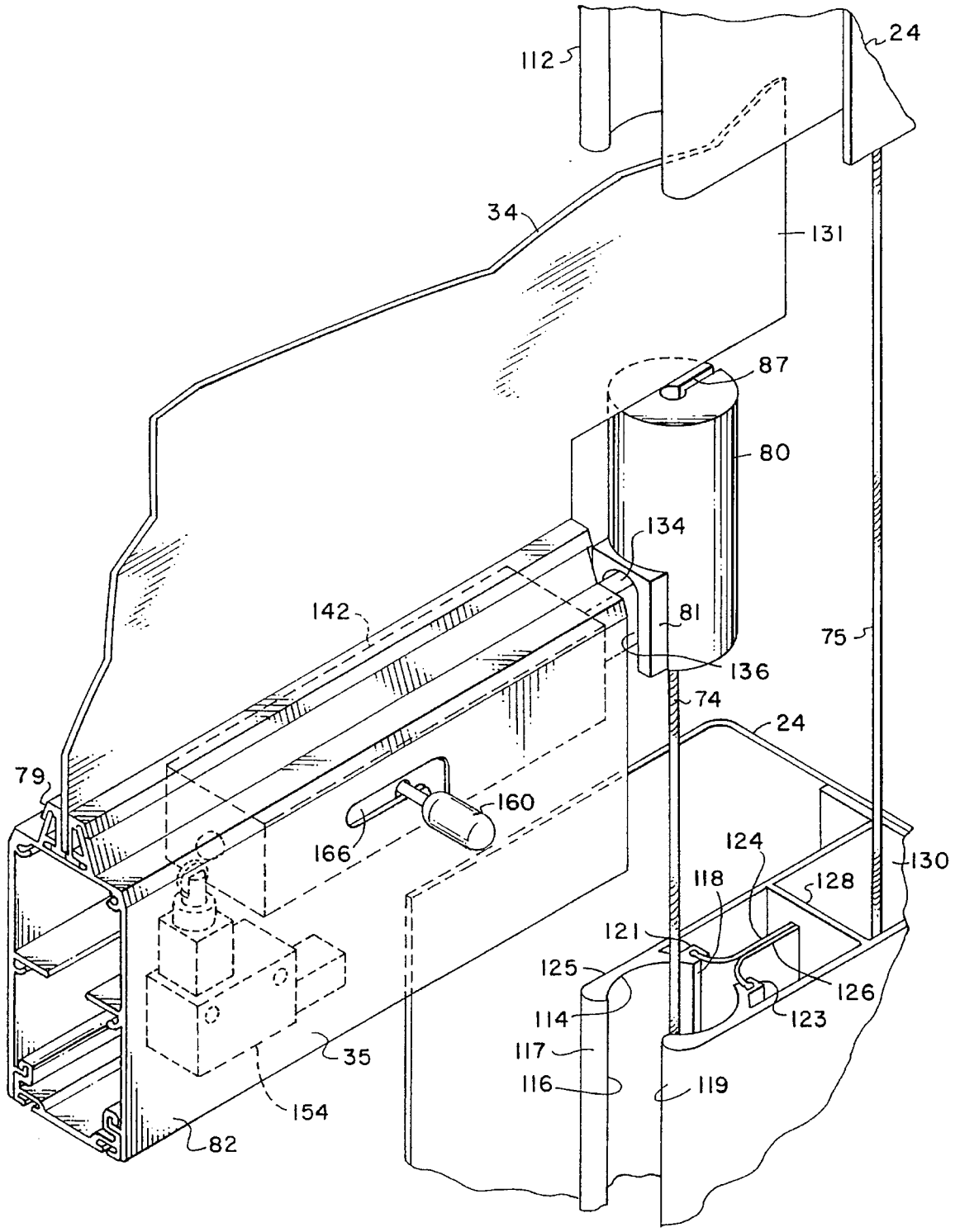
FIG. 7 is a cutaway perspective view of one of the slide member and latch assemblies.

Referring now to FIGS. 6 and 7, each of the frame members 22 and 24 comprises a generally U-shaped beam or channel section having opposed flanges 23 and 25, respectively. A unique, elongated guide member 112 is mounted within and suitably connected to each of the frame members 22 and 24, respectively, as illustrated in FIG. 6, by suitable fastener means, not shown. The guide member 112 is characterized, preferably, by an extrusion formed of a suitable engineering material such as aluminum. Each guide member 112 includes an elongated, generally cylindrical guideway 114 for slidably journalling the slide member 80. The guideway 114 is intersected by elongated, opposed slots 116 and 118, see FIG. 7 also. The slot 116 is delimited by elongated parallel guide surfaces 117 and 119 and the slot 118 is delimited by elongated, opposed bosses 121 and 123 which are adapted to support elongated, generally flat flexible seal strip members 124 and 126, respectively. The seal strips 124 and 126 are preferably formed of a suitable elastomer. The seal strips 124 and 126 provide a substantial weather-tight seal for the door closure 34 along its opposed longitudinal side edges at the frame members 22 and 24. A transverse web 128 is formed in the guide member 112 and partially defines an elongated cableway 130 through which a run 75 of the cable 74 is trained.

Figures 8, 8A, 8B:
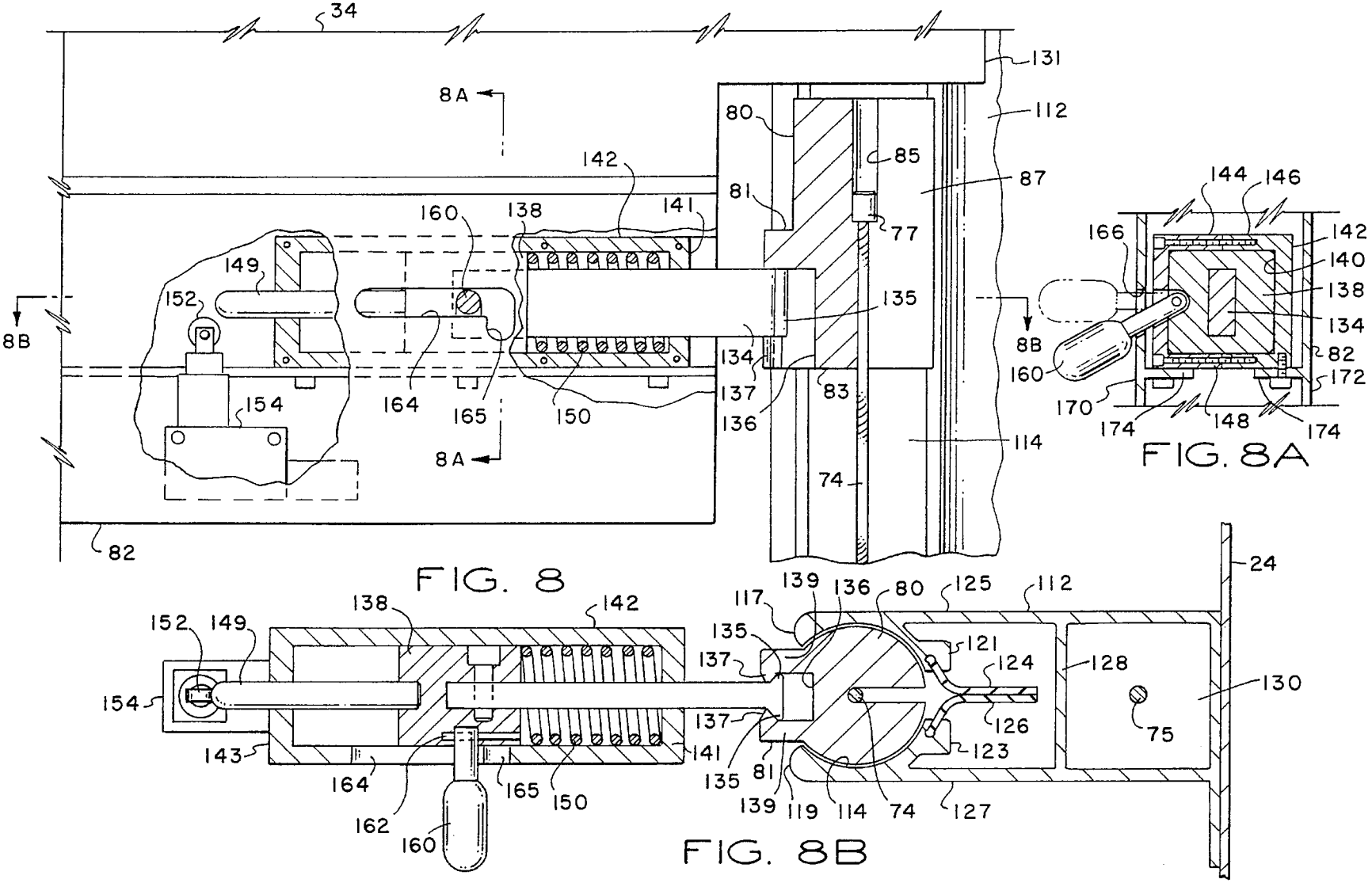
FIG. 8 is a detail elevation view, partially sectioned, of the slide member and latch assembly shown in FIG. 7.
FIG. 8A is a section view taken generally from the line 8A—8A of FIG. 8.
FIG. 8B is a section view taken generally from the line 8B—8B of FIG. 8.

As further shown in FIGS. 6 and 7, the opposite longitudinal side edges 129 and 131 of the closure member 34 extend between and are engaged by the seal strips 124 and 126, respectively. Each of the slide members 80 is adapted to be disposed in its respective guideway 114 for sliding movement therealong. However, each of the slide members 80 has a transverse, generally rectangular boss or key portion 81 which is adapted to be disposed in the slot 116 and engageable with the guide surfaces 117 and 119 to orient the guide member in the guideway. As will be appreciated from the foregoing description, the guide members 112, due to their placement between the channel flanges 23 and 25, partially define the guideways 63 and 65 for the windbar 60. The guide surfaces 117 and 119 are disposed on opposed substantially cantilever beam portions 125 and 127 of the guide 112, which beam portions may be elastically deflected to allow the guide surfaces 117 and 119 to move relative to each other for a purpose to be described hereinbelow. As shown in FIG. 8, the distal end of cable 74 includes a becket 77 secured in a stepped bore 85 in the slide member 80, which bore is intersected by a narrow slot 87 of less width than the diameter of the becket.

Referring now to FIGS. 3, 7 and 8, the beam 82 is adapted to support opposed substantially stiff, rectangular plate shaped latch members 134 which project into cooperating generally rectangular slots 136, FIG. 8, formed in the slide members 80, respectively, and opening to the transverse bottom side 83 thereof. Each latch member 134 is connected to a generally rectangular cross section plunger 138, FIG. 8, slidably supported in a cooperating rectangular cross section bore 140 formed in a support housing 142. As shown in FIG. 8, the support housing 142 may be fabricated of opposed housing sections 144 and 146 which are suitably fastened together by conventional mechanical fasteners 138, for example. As shown in FIGS. 8A and 8B, by way of example, the plunger 138 is engaged with a coil spring 150 disposed in the bore 140 and supported against an end wall 141 of the housing 142. The plunger 148 includes an elongated stem 149 which projects through a suitable bore formed in an end wall 143 and is engageable with an actuator 152 of a suitable electrical switch 154. Each plunger 138 has a stem 149 operable to engage and disengage an actuator 152 of a switch 154. If a latch member 134 becomes disengaged from a slide member 80, the plunger 138 is biased to move in a direction to cause the stem 149 to engage the switch actuator 152 allowing the switch 154 to effect immediate shutoff of the drive motor 40 to arrest movement of the closure member 34.

As shown in FIG. 8B, the distal end of the latch member 134 is provided with retaining means comprising opposed lateral projections 135 which extend the full width of the latch member, as shown, and are engageable with cooperating retaining means comprising projections defined by reentrant edges 137 of the slot 136. The slot 136 is also defined by opposed laterally projecting jaw portions 139 of the boss 81. The projections 135 and reentrant edges 137 cooperate to retain the latch member 134 in the slot 136 during normal operation of the door closure member 34. Although the slot 136 is open at the bottom transverse end 83 of the slide member 80, the slide member is tensioned by the cable 74 to move downwardly in the guide member 112, thus always retaining its engagement with the latch member 134 except under circumstances to be described herein.

As shown in FIGS. 8A and 8B, the plunger 138 has a manual actuating bolt or arm 160 pivotally connected to the plunger by a suitable pivot pin 162. The actuator arm 160 projects through an elongated J-slot 164 formed in the housing 142 and the actuator arm also projects through a co-extensive J-slot 166 formed in the sidewall of the beam 82, FIGS. 7 and 8A. As shown in FIG. 8A, the beam 82 is provided with opposed sidewalls 170 and 172 and one or more transverse webs 174 for supporting the housing 142. In the view of FIG. 8A, the J-slot 166 is formed in the sidewall 170 aligned with and coextensive with the J-slot 164. The actuator arm 160 of each plunger 138 may be used to extend the latch member 134 to engagement with the slide member 80. The latch members 134 may be held in their extended positions during connection of the latch members to the slide members 80 against the bias of their respective springs 150 by moving the respective actuator arms 160 down into the base portions 165, FIG. 8A, of the respective J-slots 164. Actuator arms 160 may be provided projecting from each side of beam 82, if desired.

The tension on the cables 74 urge the slide members 80 to move downward in the guideways 114 toward the sheaves 78 at all times during normal operation of the door 20. Accordingly, tension is maintained in the closure member 34 at all times in its rolled up, full open position as well as in its closed position. In fact, as earlier described, the tension increases as the closure member 34 is pulled to its closed position with the bottom beam 82 engaged with floor surface 21. However, the motor 40, being drivably engaged with the shaft 32 does not exert its full driving torque on the beam 82 since it is merely acting to roll and unroll the closure member by rotation of the shaft 32. Accordingly, only the tension of the cable 74 substantially urges the beam 82 downward toward the floor 21. In this way, any obstruction in the doorway 26 struck by the beam 82 during operation of the closure member 34, assuming that all obstruction sensors should fail, will only urge the beam downward with substantially the force of the tensioning cables 74 since the flexible closure member 34 would easily buckle during unrolling thereof if the beam 82 were prevented from downward movement.

If the closure member 34 is struck by a vehicle or person moving through the doorway, it should be allowed to disconnect from the guides 112 to minimize damage to the door 20 and any object striking the door. Accordingly, if a predetermined force, generally normal to the plane of the closure member 34, should strike the closure member and/or the bottom beam 82, the latch members 134 will tend to rotate the slide members 80 about their longitudinal axes, which axes coincide with the cable bores 85, formed in the slide members.

Figure 9A:
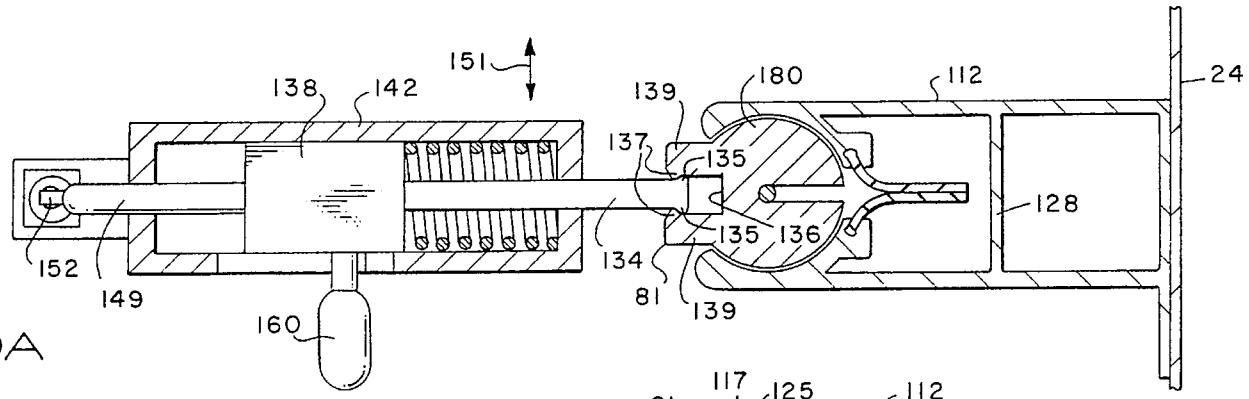
FIGS. 9A, 9B and 9C are views showing the action of the latch member shown in FIG. 8 as it disengages from the slide member.
Figure 9B:
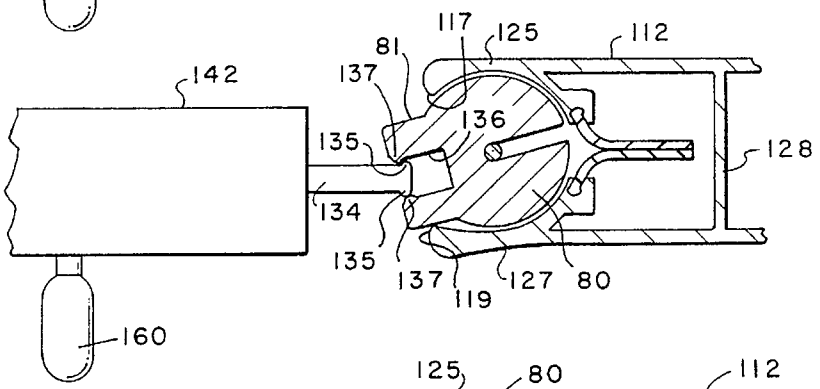
Figure 9C:
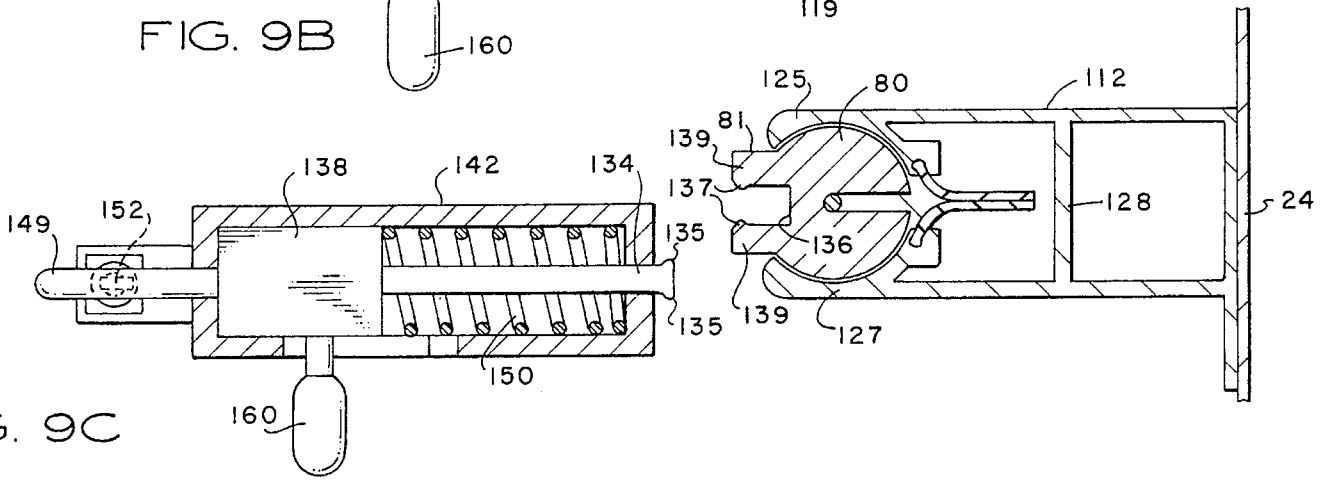

The action which will cause the latch members 134 to disengage from the slide members 80 is illustrated for one of the latch members by way of example in FIGS. 9A through 9C. The beam 82 is eliminated from FIGS. 9A through 9C for clarity. Referring to these figures, FIG. 9A shows the latch member 134 engaged with the slide member 80 in the normal working position. The reentrant edges 137 cooperate with the projections 135 on the latch member 134 to retain the latch member in engagement with the slide member 80. Moderate forces exerted in the directions of the arrow 151 in FIG. 9A may cause slight rotation of the slide member 80 about its longitudinal central axis but will not cause disengagement of the latch member 134 from the slide member. However, when a predetermined force is exerted on the door closure member 34 or the bottom beam 82, the slide member 80 will be rotated to the position shown in FIG. 9B wherein, as shown, the orientation of the slot 136 is such that the latch member 134 may exit from the slot as the projections 135 disengage from the reentrant edges 137. Moreover, the key portion 81 may be dimensioned such that one of the jaws 139 will tend to elastically deflect to widen the portion of the slot 136 between the reentrant edges 137 as the jaw forcibly engages the beam portion 127, for example. Moreover, the elasticity of the beam portion 127 can result in some deflection of the beam near the surface 119 to permit some further rotation of the slide member 80. The above described rotation will be sufficient to allow the latch member 134 to disengage from the slide member 80 and retract toward the housing 142 under the urging of the spring 150. FIG. 9C shows the disengaged condition of the latch member 134 with respect to the slide member 80. When complete disengagement occurs, the slide member 80 will return to its normal working position as the beam portions 125 or 127 tend to recenter or reorient the slide member in its working position. The latch members 134, when disengaged from the slide members 80, advantageously retract toward the housings 142 to minimize any damage to the latch members which might occur from striking an obstruction in the doorway 26.

As previously mentioned, when the latch members 134 disengage from the guide members 80, the stems 149 will effect actuation of the switches 154 to shut off the motor drive unit 40, immediately arresting movement of the door closure member 34. Moreover, as previously described, the reduced tension in the cables 74 will cause the brake arms 98 to pivot into a position to effect braking action against the tensioning reels 70 and 72. The switches 154 are, preferably, connected in series so that actuation of either of one of the switches, should only one latch member become disengaged, will still effect shutoff of the motor drive unit 40.

Figure 11:
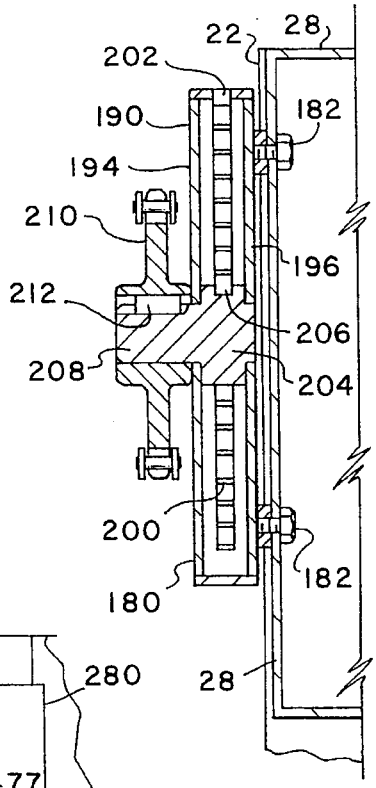
FIG. 11 is a section view taken generally from the line 11—11 of FIG. 10.

Referring now to FIGS. 10 and 11, there is shown a door counterbalance device which may be mounted on the frame bracket 28 and is similar in some respects to the cable tensioning reels 70 and 72. The counterbalance device is generally designated by the numeral 180 and is suitably supported on the bracket 28 by conventional fasteners 182 as shown in FIG. 11. The device 180 includes a generally cylindrical housing 190 having opposed side plates 194 and 196, a peripheral rim 198 interposed between the side plates and a spiral flat band-type spring 200 suitably keyed to the rim 198 at 202. The opposite end of the spiral spring 200 is connected to a hub member 204 at a connection point 206. The hub 204 is supported on and rotatable relative to the housing 190 and has a stub shaft part 208 projecting therefrom, on which is mounted a conventional chain sprocket 210 suitably keyed to the stub shaft by key means 212. As shown in FIG. 10, the sprocket 210 is drivably connected to a sprocket 214 by a conventional endless chain 218. The sprocket 214 is mounted on shaft 32*a* and suitably keyed thereto by key means 216. The spring 200 may be suitably pretensioned to effect a driving force on the hub 204 which will tend to rotate the sprockets 210 and 214 in a clockwise direction, viewing FIG. 10, to aid in counterbalancing the weight of the door closure member 34 when unreeled from the shaft 32. In other words, as the shaft 32 rotates in a counterclockwise direction, viewing FIG. 11, to unroll the closure member 34, spring tension increases in the spring 200. If this tension is insufficient, the sprockets 210 and 214 may be interchanged with sprockets of suitable pitch diameters, respectively, to effect a torque effort on the sprocket 214 which provides a suitable counterbalance effect on the shaft 32 by the device 180.

Figure 12:
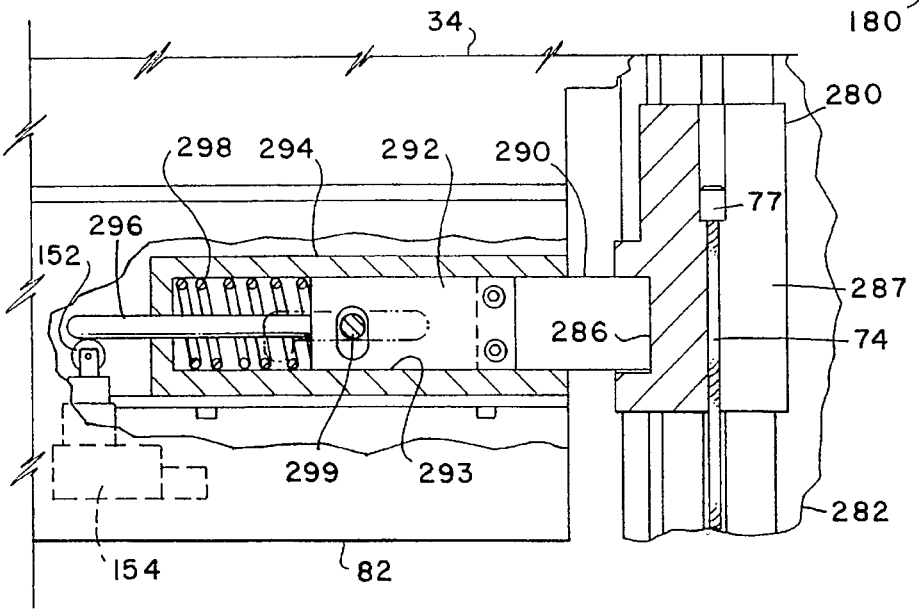
FIG. 12 is a longitudinal section view taken generally along the same line as the view of FIG. 8 showing a first alternate embodiment of a breakaway connection latch member and slide member.
Figure 13A:
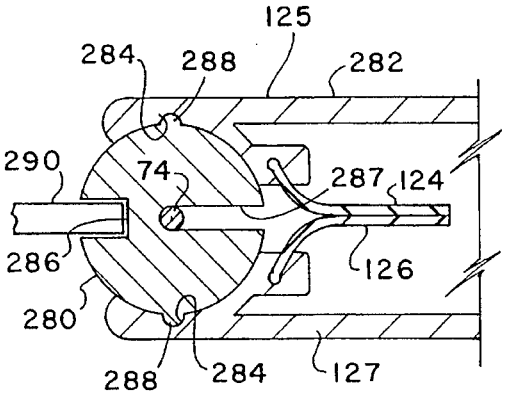
FIGS. 13A and 13B are views showing the action of the embodiment of FIG. 12.
Figure 13B:
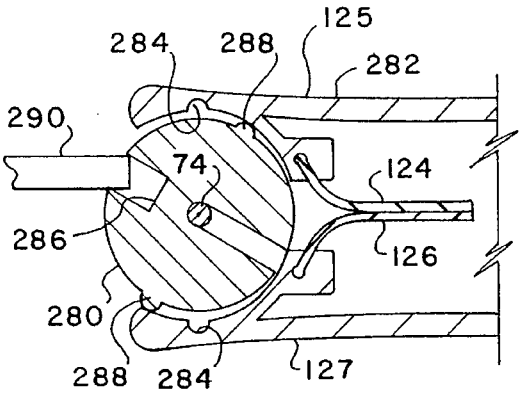

Referring now to FIG. 12 and FIGS. 13A and 13B, a first alternate embodiment of a breakaway latch connection between the door beam 82 and a tensioning cable 74 is illustrated. In the embodiment illustrated in FIGS. 12, 13A and 13B, a modified slide member 280 is disposed in a guide member 282 similar to the guide member 112 but having elongated longitudinally extending grooves 284 disposed in the opposed beam portions 125 and 127. In all other respects, the guide 282 is virtually identical to the guide 112. As shown in FIG. 13A, the slide member 280 has a longitudinally extending latch member receiving slot 286 and opposed longitudinal, radial outward projecting key portions 288 which are operable to be disposed in the grooves 284 to allow the slide member 280 to slide along the guide 282 in the same manner that the slide 80 is operable in the guide 112.

As shown in FIGS. 12 and 13A, a modified latch member 290 extends into the slot 286. The latch member 290 is also preferably a substantially stiff, generally rectangular plate shaped element which is connected to a plunger 292 slidably disposed in a bore 293 formed in a housing 294 similar to the housing 142. The plunger 292 is also of generally rectangular or square cross section to prevent rotation of the latch member 290. A switch actuating stem 296 extends from the plunger 292 in a direction opposite the latch member 290 and is engageable with the switch actuator 152. In the embodiment of FIG. 12, the plunger 292 and the latch member 290 are biased in a direction opposite that of the earlier described embodiment by a coil spring 298 disposed in the housing 294 and engaged with the plunger 292. A suitable actuating arm 299 extends from the side of the plunger 292 in a manner similar to the arrangement of the actuating arm 160 for the plunger 138.

In the operation of the latch connection shown in FIGS. 12, 13A and 13B, when a force sufficient to disconnect the latch member 290 from the slide member 280 occurs, the latch member will tend to rotate the slide member 280 but will be resisted by the projections 288 disposed in the grooves 284. However, when a sufficient force is exerted on slide member 280 by the latch member, the beam portions 125 and 127 will tend to deflect enough to allow the projections 288 to move to the position shown in FIG. 13B. In this position, the slide member 280 has rotated sufficiently to allow the latch member 290 to exit the slot 286 and disconnect from the slide member and the guide 282 even though the bias of the spring 298 is urging the latch member toward the slot.

The slide member 280 is also provided with a longitudinal slot 287 which will permit some compressive action to occur on the slide member as it tends to rotate its projections 288 out of the grooves 284. The camming action of the projections 288 will tend to effectively reduce the diameter of the slide member 280 to allow the projections to exit the grooves 284 and assume the position shown in FIG. 13B. Accordingly, the flexing of the beam portions 125 and 127 and/or the flexing of the body of the slide member 280 itself will allow movement of the projections 288 out of the grooves 284 to allow the slide member to assume the position shown in FIG. 13B.

One advantage of the arrangement illustrated in FIGS. 12, 13A and 13B is that the slide member 280 will tend to remain in the position at which it disconnected from the latch member 290 due to the elastic gripping forces exerted on the slide member when the projections 288 have cammed out of the grooves 284 to the position shown in FIG. 13B. The slide members 280 will, of course, require repositioning so that the projections 288 extend into the grooves 284 prior to reconnecting the latch members 290 with the slide members. Each of the latch members 290 may be retracted by the aforementioned arm 299 so that the latch members may be positioned adjacent the slots 286 and then the arms released to allow the latch members to reengage with the slide members 280 once the slide members and the bottom beam 82 have been properly positioned relative to each other to provide for reengagement of the breakaway connections formed by the slide members and latch members.

Figure 14:
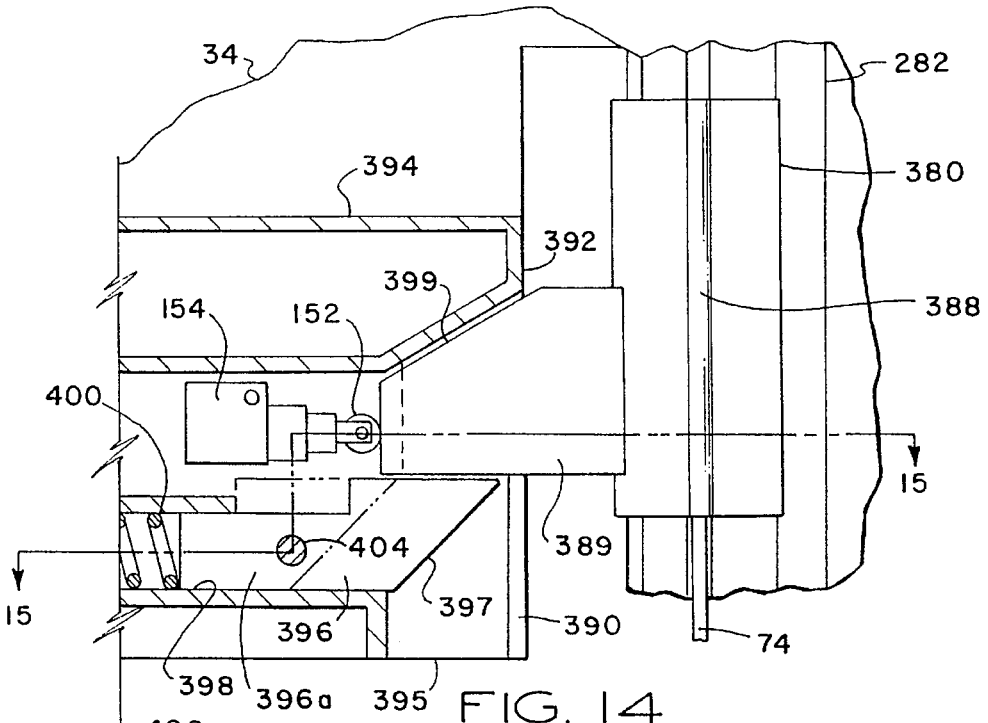
FIG. 14 is a section view similar to the section views of FIGS. 8 and 12 showing a second alternate embodiment of a breakaway connection in accordance with the invention.
Figure 15:
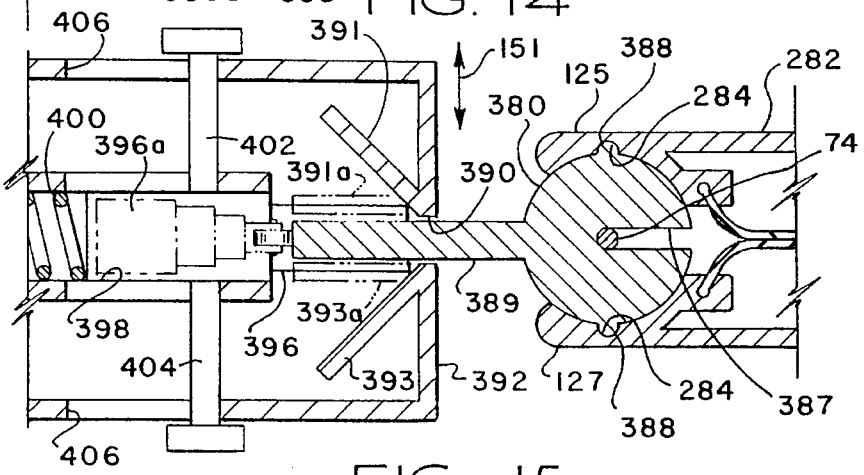
FIG. 15 is a section view taken generally from the line 15—15 of FIG. 14.

Referring now to FIGS. 14 and 15, there is illustrated a second alternate embodiment of a breakaway connection for connecting a bottom beam of a door closure member to guide members 282, one shown in FIGS. 14 and 15. In the embodiment of FIGS. 14 and 15, a modified slide member 380 is shown disposed in one of the guides 282 between the beam portions 125 and 127 and having elongated opposed radial outward projecting key portions 388 registrable in the grooves 284 as shown in FIG. 15. The slide member 380 has a longitudinally extending slot 387 formed therein and is suitably attached to the cable 74 in a manner similar to the embodiment shown in FIG. 8. However, the slide member 380 has a laterally projecting plate or fin like latch member 389 secured thereto and projecting into a slot 390 formed in a transverse end wall 392 of a modified closure member transverse bottom beam 394, suitably connected to the door closure member 34 in a manner similar to the embodiment of FIGS. 1 through 8. The beam 394 is also provided with a retractable bolt member 396, engageable with the latch member 389 to transfer the pulldown effort of the cables 74 from the slide members 380 to the door closure member 34. Each of the bolts 396, one shown, has a rectangular cross section shank part 396*a* disposed in a suitable complementary bore 398 formed in the beam 394 and biased by a spring 400 into the position shown in FIGS. 14 and 15. Opposed actuator arms 402 and 404 are provided projecting from opposite sides of the beam 394 and disposed in suitable slots 406 to provide for manually retracting the bolt 396 so that the latch member 389 may be reinserted in the groove 390 when it becomes disengaged from the beam 394.

In the operation of the embodiment of the breakaway connection shown in FIGS. 14 and 15, if the door closure member 34 and/or the beam 394 are struck with a sufficient force, the beam 394 will urge the slide members 380 to rotate to cam the key portions 388 out of the slots 284 by either elastically deflecting the beam portions 125 and 127 and/or radially compressing the body of the slide member 380, thanks to the provision of the slot 387. Rotation of the slide member 380 will allow the latch member 389 to slide out of the slot 390 as the beam 394 tends to move in one direction or another, as indicated by the double arrow 151. Movement of the latch member 389 out of the slot 390 will, of course, result in actuation of the switch 154 due to disengagement of the actuator 152 from the distal end of the latch member 389 to effect shutoff of the motor drive unit 40. When it is desired to reengage the beam 394 with the latch member 389, the slide member 380 is rotated back to the position shown in FIG. 15, the bolt 396 is retracted and the beam 394 is lowered to a position to allow the latch member 389 to reenter the slot 390, which is open at the lower side 395 of the beam 394. The bolt 396 is preferably provided with a sloping cam surface 397 which cooperates with a sloping surface 399 formed on the latch member 389 to facilitate automatic reengagement of the latch member into the slot 390 by a camming action which effects retraction of the bolt 396 against the bias of spring 400.

FIG. 15 also illustrates sidewall extensions of the slot 390 formed by cantilever wall portions 391 and 393 which are each disposed at about a 45° angle to the plane of the normal position of the latch member 389 and allow the latch member to rotate sufficiently in the slot to exit the slot upon rotation of the slide member 380 in the guide 282. However, the slide member 380 may be modified to eliminate the projections 388 and the slot sidewalls 391 and 393 may be modified to extend generally parallel to the plane of the latch member 389 as indicated by numerals 391*a* and 393*a*. These cantilever sidewalls may be configured to be resiliently deflectable to allow the latch member 389 to undergo rotation in the slot in response to a force acting on the beam 394 or the closure member 34 and of sufficient magnitude to effect rotation of the slide member 380 to a position such that the latch member 389 will exit the slot 390. In other words, the resilient bias forces which tend to position the latch member 389 in the slot 390 in the position illustrated in FIG. 15 may be provided by the projections 388 or by the cantilever wall portions 391*a* and 393*a* of the slot 390.

Figure 16:
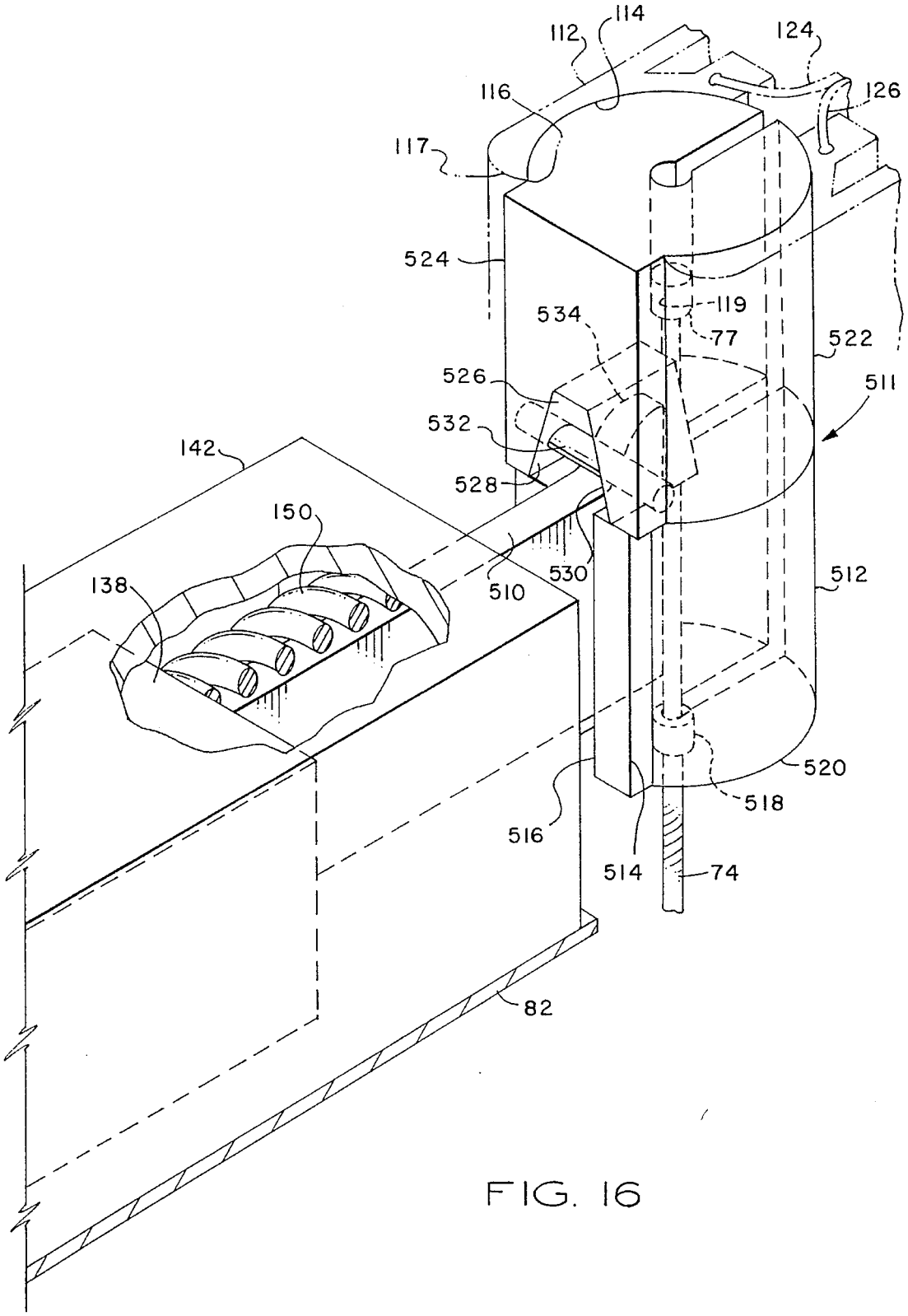
FIG. 16 is a perspective view of a third alternate embodiment of a breakaway connection in accordance with the invention.

Referring now to FIG. 16, there is illustrated yet another embodiment of a breakaway connection for the roll-up door 20 for guiding the bottom beam 82 between the guide members 112 while permitting release of respective latch members between the beam and the guide members. FIG. 16 shows one of the latch members of the third alternate embodiment, generally designated by the numeral 510. The latch member 510 is characterized as a generally rectangular plate member which is secured to a plunger 138 in the same manner as the latch member 134 and is biased by a spring 150 disposed in a housing 142. A slide member 511 is connected to the cable 74 and is slidably disposed in the guide member 112 within the guideway 114. The slide member 511 is characterized by a first lower slide part 512 comprising a generally cylindrical member with a laterally projecting key portion 514 having a width less than the distance between the guide surfaces 117 and 119 of the guide member 112. The slide part 512 has an elongated slot 516 formed therein for receiving the latch member 510 and the slide part 512 is secured for movement with the cable 74 by a suitable becket 518 engaged with the bottom transverse side 520 of the slide part 512.

A second or upper slide part 522 is provided as a generally cylindrical member adapted to be slidably disposed in the guideway 114 and secured to the cable 74 by a becket 77. The slide part 522 also has a laterally projecting key portion 524 which is of substantially the same width as the distance between the guide surfaces 117 and 119 and thus the slide part 522 undergoes essentially no rotation about its longitudinal central axis. On the other hand, the lower slide part 512 is operable to undergo limited rotation since the width of its key portion 514 is less than the distance between the guide surfaces 117 and 119. The slide part 522 has a laterally projecting slot 526 formed therein for receiving a portion of the latch member 510, which slot is defined by opposed sloping cam surfaces 528 and 530. A transversely extending retaining pin 532 is disposed in the slot 526 and engages an upward directed retaining projection 534 disposed on the distal end of the latch member 510.

In the normal operation of the door 20, with latch members 510 and slide parts 512 and 522 operably associated therewith, the latch member 510 is retained in engagement with the slide members by the engagement of the projection 534 with the retaining pin 532. Accordingly, the spring 150 urges the latch member 510 out of the slots 516 and 526 but the aforementioned interengagement between the projection 534 and the retaining pin 532 prevents disengagement of the latch member from the slide parts 512 and 522. However, when a force urging the bottom beam 82 in a direction normal to the plane of the closure member 34 is reacted through the latch member 510 and the slide member 511, the slide part 512 will rotate until the key portion 514 engages one or the other of the guide surfaces 117 or 119. The lower slide part 512 acts primarily as a means to prevent rotation of the latch member 510 and the bottom beam 82 about their longitudinal axes. However, as the latch member 510 begins to move with respect to the slot 526, it engages one or the other of the cam surfaces 528 or 530 tending to urge the slide part 522 upwardly or longitudinally along the central axis of the cable 74 with respect to the slide part 512 and the latch member. When a sufficient camming effect between the latch member 510 and one of the surfaces 528 or 530 occurs, the projection 534 will be moved to a point relative to the slide part 522 to allow it to slip from under the retaining pin 532 thus allowing the latch member 510 to retract toward the housing 142 and disconnecting the bottom beam 82 from the guide 112.

As with certain ones of the other embodiments, the latch members 510 may be reconnected to their respective slide members 511 when the slide members have moved to the bottom of the guideway, and have been arrested at a suitable distance above the floor surface 21, by lowering the closure member 34, extending the latch member 510 and reinserting it into the slots 516 and 526 to engage the pin 528, since the slot 516 is open throughout the entire length of the slide part 512. Accordingly, with the embodiment of FIG. 16, the slide member which reacts with the latch member 510 to release a retaining connection therebetween does not undergo any rotation with respect to the cable 74 or the guideway 114. Thanks to the slide part 512, a slot 516 of sufficient width is provided to cooperate with the latch member 510 to minimize a tendency for the beam 82 to rotate about its axis. At the same time, the slide part 512 is able to undergo limited rotation to provide for engagement of the latch member 510 with the cam surfaces 528 or 530 to effect disconnection of the latch member from the slide part 522.

Figure 17:
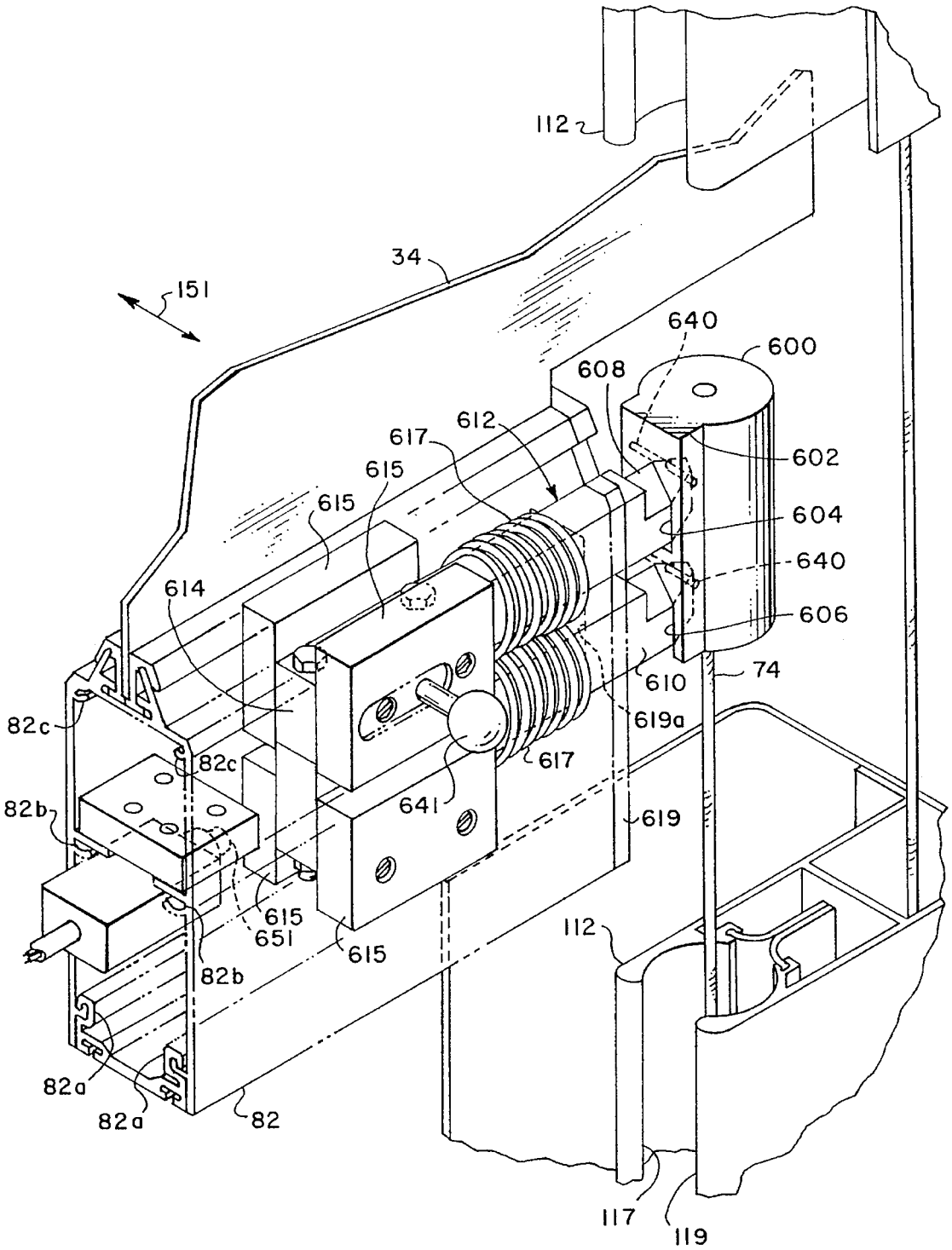
FIG. 17 is a perspective view of a fourth alternate embodiment of a breakaway connection in accordance with the invention.
Figure 18:
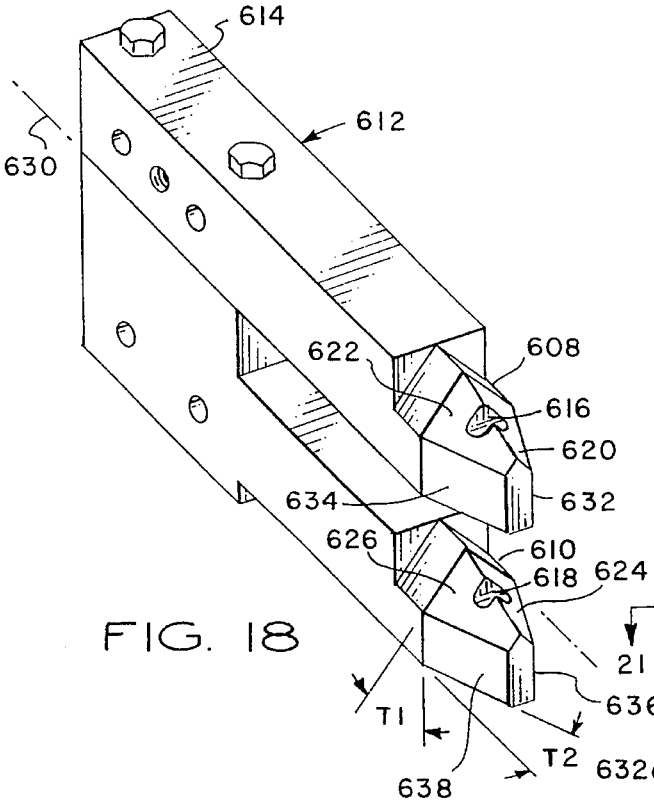
FIG. 18 is a perspective view of the latch member for the breakaway connection of the embodiment of FIG. 17.
Figure 19:
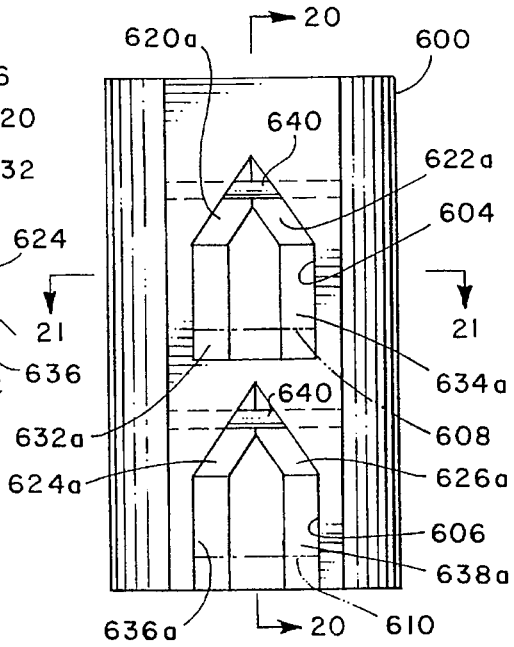
FIG. 19 is a front elevation of the slide member of the embodiment of FIG. 17.
Figure 20:
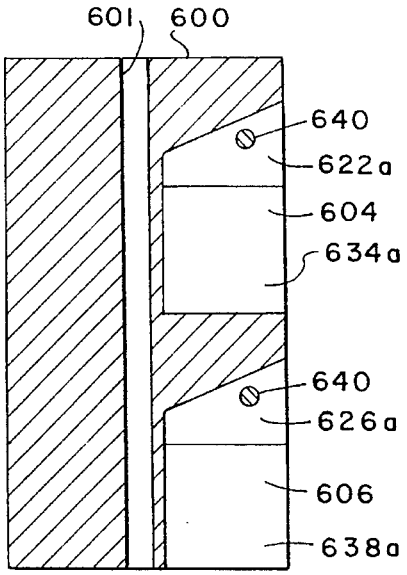
FIG. 20 is a section view taken generally from the line 20—20 of FIG. 19.

Another preferred embodiment of a breakaway connection for the door assembly 20 is illustrated in FIGS. 17 through 21. Referring to FIG. 17, a generally cylindrical slide member 600, similar in some respects to the slide member 80, is connected to the cable 74 and is slidably disposed in the guide 112. The slide member 600 includes a laterally projecting key portion 602 corresponding to the key portion 81 of the slide member 80 and operable to project between the guide surfaces 117 and 119 of the guide 112. Referring briefly to FIGS. 19 and 20 also, the guide member 600 includes a central axial bore 601 for receiving the cable 74 and two spaced apart slots or recesses 604 and 606 which are vertically spaced apart and are adapted to receive laterally projecting tines 608 and 610, FIG. 17, of a unique latch member 612. The latch member 612 includes a base portion 614 supported by and suitably secured to spaced apart bearing blocks 615 which are disposed in the hollow boxlike bottom beam 82 for support by and sliding movement along suitable flange portions **82*a*, 82*b* and 82*c*, as shown. As shown in FIG. 17, the latch member 612 is also biased to retract from engagement with the slide member 600 by coil springs 617 disposed in the beam 82 and around the respective tines 608 and 610 and retained by a removable end plate 619, having a slot 619*a* formed therein for the tines 608 and 610** to project through.

Referring now to FIG. 18, each of the tines 608 and 610 of the latch member 612 has a transverse slot or groove 616 and 618, respectively, forming hook means for engagement with cooperating retaining means to be described herein and disposed in the slide member 600. The tine 608 has opposed cam surfaces 620 and 622 and the tine 610 also has similar opposed cam surfaces 624 and 626. The cam surfaces 620, 622 and the cam surfaces 624, 626 slope toward each other, respectively, and toward a vertical plane passing through a central axis 630, viewing FIG. 18. A second set of opposed cam surfaces 632 and 634 is formed on the tine 608 and a corresponding set of cam surfaces 636 and 638 is formed on the tine 610. As indicated in FIG. 18, each of the cam surfaces 620, 622 and the cam surfaces 624, 626 form an acute angle with respect to the vertical plane indicated as angle T1. The cam surfaces indicated 632, 634 and 636, 638 each also form an acute angle T2 with respect to a vertical plane passing through the axis 630. The angles T1 and T2 may be about 41° and 20°, respectively.

Figure 21:
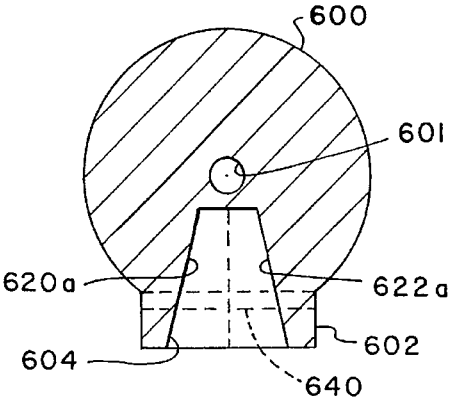
FIG. 21 is a section view taken from the line 21—21 of FIG. 19.

Referring now to FIGS. 19, 20 and 21, the slots 604 and 606 in the slide member 600 have cooperating cam surfaces which engage the aforedescribed cam surfaces on the latch member tines 608 and 610. Moreover, each of the slots 604 and 606 has a transverse retaining pin 640 projecting therethrough, as illustrated, and suitably secured on the slide member 600. The retaining pins 640 are operable to be disposed in the slots 616 and 618 of the latch member 612 to retain the latch member engaged with the slide member 600. Cam surfaces **620*a* and 622*a* are formed in the slot 604 and are generally parallel to and engageable with the cam surfaces 620 and 622. In like manner, cam surfaces 624*a* and 626*a* are formed in slot 606 and are engageable with the cam surfaces 624 and 626. Still further, cam surfaces 632*a* and 634*a* are formed in slot 604 for engagement with cam surfaces 632 and 634 and cam surfaces 636*a* and 638*a* are formed in slot 606, and are engageable the cam surfaces 636 and 638**, respectively.

The aforedescribed cam surfaces on the slide member 600 and the cooperating cam surfaces on the latch member 612 provide for breakaway of the bottom beam 82 of the door closure 34 in response to a force exerted in either direction generally along the line of arrow 151 and normal to the plane of the closure 34. Initially, the cam surfaces 622, **622*a* and 626, 626*a* or the opposed sets of cam surfaces 620, 620*a* and 624, 624*a* will react each of opposed ones of the latch member 612 with respect to its associated slide member 600 to effect relative movement between the latch member and the slide member generally along the longitudinal axis of the cable 74. The slide member 600 will tend to rotate in the guide 112 but the key portion 602 will engage one or the other of surfaces 117 or 119. This movement will cause the retaining pins 640 to move out of the slots 616 and 618 whereby the bias of the springs 617 will tend to move the latch member 612 out of the slots 604 and 606 to disengage from the slide member 600**.

Once the retaining pins 640 have disengaged from the tines 608 and 610, the cam surfaces 632, 632*a* and 636, 636*a*, or alternatively, the cam surfaces 634, 634*a* and 638, 638*a* may also exert a force on the latch member 612 tending to move it along the axis 630 to assist the coil springs 617 in rapidly retracting the latch member 612 out of engagement with the slide member 600. If the latch member 612 should engage the guide surfaces 117 or 119, the cam surfaces 632 and 636 or 634 and 638 will engage these guide surfaces to further assist in retracting the latch member into the beam 82 due to the reactive forces exerted thereon. When the latch member 612 retracts into the beam 82 it will engage a switch 641, similar to switch 154, to effect shutoff of the door drive motor in the same manner as described hereinabove for the other embodiments of the roll-up door. The door bottom beam 82 is, of course, provided with opposed latch members 612 and corresponding slide members 600 may be disposed in each of the guides 12 and suitably secured to respective ones of the cables 74.

The latch member 612 is advantageously provided with two spaced apart tines 608 and 610 engageable with the slide member 600 to minimize any tendency for the bottom beam 82 to rotate about its longitudinal axis and to minimize the concentration of forces exerted on the slide member 600 by the latch member 612 and wear on the slide member caused by the reaction forces between the slide member and the guide 112.

The breakaway connection formed by the latch members 612 and corresponding guide members 600 may be reconnected by positioning the bottom beam 82 adjacent to the slide members 600 and moving the latch members 612 against the bias of springs 617 by an actuating bolt 641, FIG. 17, until the tines 608 and 610 are hooked in engagement with the retaining pins 640.

The door assembly 20 may be constructed of conventional engineering materials used for roll-up type door closures and associated components. The frame members 22, 24, 28, 30 and 38 may be formed of steel or aluminum plate or channel, for example. The guides 112 and 282 are preferably formed of aluminum extrusion. The slide members 80, 180, 280, 380, 511 or 600 may be formed of a material which is suitable for low friction sliding movement in the guides 112 and/or 282 and are preferably formed of a substantially self-lubricating plastic material such as high molecular weight polyethylene or nylon, for example. The remaining components, not previously discussed, may be made of conventional and compatible engineering materials. The support brackets 28, 30 and the transverse beam member 38 may be assembled with the shaft 32, the motor 40 and the drive mechanism therefor, as well as the counterbalance mechanism described in conjunction with FIGS. 10 and 11, if used. The tensioning reels 70 and 72 and the windbar reels 52 and 54 and, of course, the closure member 34 are assembled on the shaft 32.

The frame members 22 and 24, in assembly with the respective guides 112 or 282 may be erected at a doorway and the assembly of the components described above supported by the brackets 28, 30 and beam 38 may then be mounted at the upper end of the frame members 22 and 24 and the cables 74 strung, connected to the slides 80 and to the reels 70 and 72. The slides 80, 180, 280, 380, 511 or 600 may then be connected to the bottom beam 82 or 394 by way of their corresponding latch members. The windbar 60 may be inserted in the associated guideways of the frame members 22 and 24 with its traversing cables suitably secured thereto. The tensioning reels 70 and 72 may be prewound to place a predetermined tension in the springs disposed therein and these reels clamped to the brackets 28 and 30 until the cables have been strung and the slide members connected to the bottom beam by way of the latch members. The aforementioned clamps, not shown, may then be removed from the reels to allow the cables 74 to be suitably tensioned.

Operation of the door 20 may be carried out using suitable controls known to those skilled in the art for operating the motor 40. Obstruction sensors may be placed in such a way to sense obstructions across the doorway 26 to prevent operation of the closure member 34. The motor 40 is also, of course, deenergized if either one of the switches 154 is actuated by predetermined movement of the latch members. When the door closure member 34 is unreeled from the shaft 32, the spring tensioning reels 70 and 72 will urge the cable 74 to be wound thereon maintaining tension in the cables and on the slide members with an actual increasing pull down effort on the bottom edge 35 of the door. If the door closure member 34 and/or the transverse beam 82 or 394 is impacted with sufficient force to effect disengagement of one or both of the latch members from their respective slide members, the reduced tension in the cable 74 will cause the brake arms 98 to rotate to effect braking action against the reels 70 and 72 to prevent rapid and uncontrolled reeling of the cable 74 and movement of the slide members toward the bottom of the guides 112 or 282.

In regard to the embodiment of FIGS. 1 through 9C, when the bottom beam 82 has become disconnected from the slide members 80 at one or both ends thereof, the latch member or members 134 may be extended by moving the bolt actuator arms 160 against the bias of the springs 150 until the arms may be locked in the J-slot portions 165. The door closure, including the bottom beam 82, may then be aligned with the guides 112, the longitudinal side edges of the closure member 34 reinserted between the seal strips 124 and 126 and, when the latch members 134 are reengaged with the slide members 80, the actuating arms 160 may be moved to release the plungers 138. Since the slide members 80 have normally traversed to the bottoms of the guides 112, after a complete disconnect, the closure member 34 may be moved downward by actuation to release a manually actuatable brake, not shown, associated with the motor 40 and manually pulling the bottom beam 82 down to the position wherein the latch members 134 may be reinserted in the slide members 80. Once the latch members 134 have reengaged the slide members 80, the switches 154 will be in position to permit the motor control system to reenergize the motor 40 on command. With respect to the various embodiments shown and described, the switches 154 maybe placed in suitable circuits to effect control of the motor unit 40 upon either engagement or disengagement of actuators 152, whichever is appropriate.

Those skilled in the art will appreciate from the foregoing description that the roll-up door 20 offers several advances in the art. The frame members 22 and 24 present a reduced "footprint" with respect to the floor area surrounding a doorway. The assembly of the frame members 22 and 24 and their associated guides may be separately fabricated and transported to an erection site along with the assembly of the frame members 28, 30 and 38, the shaft 32 and all of the components which are normally mounted on the shaft. This arrangement simplifies erection of the door 20 at the site at which it is to be installed since the frame members 22 and 24 may be secured to a wall adjacent a doorway and then the assembly of the frame members 28, 30 and 38, and the associated components mounted thereon, may be mounted on the frame members 22 and 24.

The aforedescribed tensioning mechanism and drive mechanism for the closure member 34 reduces the risk of injury or damage to the door 20 in the event of an obstruction disposed between the bottom beam 82 and the floor surface in that, if all motor shutoff controls should fail, the force acting to move the door closure member 34 downward is not as great as if the motor was connected to the tensioning cables themselves. In other words, the motor drive effort is not applied directly to the bottom beam 82 but only the force of the tensioning reels and associated springs working through the cables 74 exerts a pulldown or tensioning effort on the door. Moreover, all of the aforedescribed combinations of slide members and latch members permits one person to effect reconnection of the bottom beam to the slide members in the event that the closure member 34 becomes disconnected from the guides 112 or 282.

Although preferred embodiments of a roll-up door have been described hereinabove in detail, those skilled in the art will also recognize that various substitutions and modifications may be made to the unique features of the door without departing from the scope and spirit of the invention recited in the appended claims.

What is claimed is:

1. A roll-up door for forming a barrier across a doorway comprising:

rotatable shaft means having a flexible closure mounted thereon to be rolled and unrolled to form a movable closure for said doorway;

spaced apart guide means disposed generally at opposite sides of said doorway; and latch means disposed at opposite sides of a bottom edge of said closure for latching said closure to respective ones of said guide means for linear traversal along said guide means, said latch means comprising a first member comprising a slide member supported in said guide means for linear traversal therealong and a second member supported on said closure and cooperable with said first member to releasably latch said bottom edge of said closure to said guide means, said second member comprising a latch member projecting into a slot formed in said slide member, cooperating retaining means on said members of said latch means, respectively, for latching said closure to said guide means, said latch means being operable to provide disconnection of said bottom edge of said closure from said guide means in response to a force acting on said closure generally transversely with respect to the plane of said closure, said latch member being cooperable with cam surfaces defining said slot in said slide member and said cam surfaces defining said slot in said slide member cooperate with corresponding cam surfaces formed on said latch member to effect linear translation of said slide member relative to said latch member to effect disconnection of said latch member from said slide member and urging of said latch member out of said slot in said slide member whereby at least one of said members of said latch means undergoes one of limited rotation and linear translation with respect to the other member in response to said force to effect disconnection of said bottom edge of said closure from said guide means.

2. The roll-up door set forth in claim 1 wherein:

said latch member includes slot means formed therein and cooperable with retaining means disposed in said slot in said slide member for retaining said latch member connected to said slide member.

3. The roll-up door set forth in claim 2 wherein:

said latch member includes two spaced apart tines, each of said tines having said cooperating cam surfaces formed thereon and at least one of said tines having said slot means formed therein for cooperation with retaining means disposed in a corresponding portion of said slot in said slide member.

4. A breakaway connection for a roll-up door having a flexible closure operable to be rolled and unrolled across a doorway, said roll-up door including elongated spaced apart guides disposed generally at opposite sides of said doorway, said breakaway connection comprising a slide member disposed in at least one of said guides for sliding movement therealong, said slide member having slot means formed therein with opposed cam surfaces and retaining means disposed across said slot means, said breakaway connection further comprising a latch member connected to said closure and including a portion adapted to project into said slot means in said slide member and having corresponding cam surfaces engageable with the cam surfaces in said slide member and means forming a hook engageable with said retaining means in said slot for retaining said latch member engaged with said slide member, said breakaway connection being responsive to a force exerted on said closure to effect translation between said guide member and said latch member in response to reaction forces exerted on said cam surfaces to move said slide member relative to said latch member along said guide and to urge said latch member to move laterally with respect to said guide out of engagement with said slide member.

5. The breakaway connection set forth in claim 4 wherein:

said cam surfaces formed on said slide member and said latch member include first set of cam surfaces which urge said slide member in one direction relative to said latch member and a second set of cam surfaces which urge said latch member to move relative to said slide member in a direction generally normal to said first mentioned direction.

6. The breakaway connection set forth in claim 5 wherein:

said latch member includes two laterally projecting tines engageable with corresponding retaining means in corresponding slots formed in said slide member, each of said tines having a set of cam surfaces cooperable with a corresponding set of cam surfaces formed in the corresponding slot in said slide member.

* * * * *